US005348058A

United States Patent [19]

Ruhl

[11] Patent Number: 5,348,058

[45] Date of Patent: Sep. 20, 1994

[54] CLEAN-IN-PLACE FILLING MACHINE

[75] Inventor: Mark A. Ruhl, Baltimore, Md.

[73] Assignee: National Instrument Company, Inc., Baltimore, Md.

[21] Appl. No.: 972,808

[22] Filed: Nov. 6, 1992

[51] Int. Cl.[5] ..... B65B 3/04

[52] U.S. Cl. ..... 141/1; 141/89; 141/90; 141/91; 141/92; 134/169 C; 222/148

[58] Field of Search ..... 141/1, 89, 90, 91, 92; 134/57 R, 168 C, 169 C; 137/240; 222/148

[56] References Cited

U.S. PATENT DOCUMENTS

| | | | |
|---|---|---|---|
| 2,458,230 | 1/1949 | Warcup . | |
| 3,498,502 | 3/1970 | Breitenstein et al. . | |
| 4,095,920 | 6/1978 | Needham et al. . | |
| 4,136,719 | 1/1979 | Kronseder et al. | 141/1 |
| 4,168,677 | 9/1979 | Brown . | |
| 4,195,672 | 4/1980 | Freeman | 141/91 |
| 4,273,263 | 6/1981 | Voegele et al. | 222/140 |
| 4,319,612 | 3/1982 | Golding | 141/1 |
| 4,347,877 | 9/1982 | Hoiss | 141/91 |
| 4,351,354 | 9/1982 | Hilterhaus et al. | 137/240 |
| 4,407,431 | 10/1983 | Hutter, III | 222/1 |
| 4,465,210 | 8/1984 | Iwanami | 222/148 |
| 4,501,622 | 2/1985 | Marchadour | 141/90 X |
| 4,516,596 | 5/1985 | Sugisawa et al. | 137/240 |
| 4,573,486 | 3/1986 | Weiss | 134/104 |
| 4,582,226 | 4/1986 | Doak | 222/148 |
| 4,606,476 | 8/1986 | Pocock et al. | 222/148 |
| 4,623,516 | 11/1986 | Weiler et al. | 422/28 |
| 4,667,709 | 5/1987 | Fischer et al. | 141/91 |
| 4,842,026 | 6/1989 | Nordmeyer et al. | 141/1 |
| 4,848,381 | 7/1989 | Livingston et al. | 134/57 R |
| 4,860,926 | 8/1989 | Juenkersfeld | 222/148 |
| 4,913,202 | 4/1990 | Miller et al. | 141/90 X |
| 4,993,598 | 2/1991 | Groninger | 222/148 |
| 5,223,217 | 6/1993 | Frizziero | 141/90 X |

*Primary Examiner*—Ernest G. Cusick
*Attorney, Agent, or Firm*—Barnes & Thornburg

[57] ABSTRACT

A clean-in-place filling machine which includes a supply tank connected to a filling nozzle by a filling unit and additionally a flush tank connected to a pump or drain outlet by a valve. A programmable controller operates the machine to fill a container with product from the supply tank via the filling unit and the nozzle, and performs a clean-in-place with a pre-rinse, a wash and a final rinse. The initial rinse is performed by rinsing with a rinsing fluid introduced into the supply tank and exiting the drain outlet via the filling unit, the nozzle, the flush tank and the valve. This is followed by washing with cleaning fluid from the flush tank via the valve, the pump, the supply tank, the filling unit and the nozzle back to the flush tank. This is a closed loop wherein the pressure is provided by the pump and the filling unit is operated to drain the supply tank. The final rinse, rinses with rinsing fluid introduced into the supply tank and exiting the drain outlet via the filling unit, the nozzle, the flush tank and the valve. The pump is disconnected from the supply tank during the final rinse and the valve may be operated to alternately connect the rinsing fluid from the flush tank to the pump to also clean the pump separately.

23 Claims, 7 Drawing Sheets

CLEAN-IN-PLACE FILLING MACHINE

TECHNICAL FIELD

The present invention relates generally to filling machines, and more specifically to a clean-in-place filling machine.

BACKGROUND ART

Filling machines periodically have to be cleaned. The most primitive and time consuming method is disassembling the machine, including the filling tank, the filling unit and all the hoses, and cleaning them individually. A less primitive system is where the system is operated normally with a cleaning or rinsing solution. This has come to be known in the industry as clean-in-place. Cleaning fluids, for example, water or chemicals are generally applied to the supply tank and the filling unit is operated through the dispensing nozzle to a drain in order to flush or clean the system. Other systems have been used, wherein the output of the nozzle has been connected back to the supply tank to create a closed loop with or without an additional pump. The additional pump allows greater pressure to be applied throughout the system to clean the hoses or other connections.

These previous designs have been added to or are adaptations of the standard filling cycle and have been designed around the filling machine. Depending upon the type of filling unit, and the degree of cleanliness or sterility required, substantial modifications had to be made. To truly clean a system, all surfaces which contact the filling material must be cleaned. This requires special operation of the valves on the filling unit as well as the portions of the filling unit. Additional ports and restructuring of the piston pump or other positive placement pumps were required. As an alternative, the displacement pump had to be disassembled for cleaning. Similarly, with the inlet and outlet valving of the filling pump, special operation or disassembly was required.

Another shortcoming of the prior art clean-in-place systems was that the filling unit was designed to fill one specific product. Thus, the clean-in-place cycles of operating including time, cycle of operation and cleaning materials to be dispensed were designed for that single product. This limits the design of the machine to dispense only that product. Each material being dispensed needs a different cleaning cycle as well as different cleaning fluids.

Where the material to be filled into a container is a heavy or dense product, the diameter of the inlet to the filling unit from the supply tank is substantially greater than the diameter of the outlet. This causes uneven flow and pressures on the inlet and outlet during the intake and discharge cycles of the filling unit during cleaning. These uneven cycles do not affect the filling operation, but make cleaning of the system using the filling unit in the cleaning cycle does not produce appropriate cleaning since the cleaning fluid is not a heavy material. The operation of the filling unit at an increased speed to create the appropriate pressures and turbulence at the output of the filling unit will not create the similar turbulence or velocity at the inlet and outlet.

Another design problem of the prior art is using the product supply tank as the source of cleaning fluid. By filling the supply tank with cleaning fluid, the surfaces are covered with an appropriate depth of cleaning fluid, therefor it cannot be cleaned by the turbulence or velocity of the cleaning fluid entering the supply tank.

DISCLOSURE OF THE INVENTION

Thus, it is an object of the present invention to provide a clean-in-place filling unit which was designed from the beginning as a clean-in-place system verses an adaptation of a filling unit.

Another object of the present invention is to provide a clean-in-place filling unit which can dispense and clean any number of materials without mechanical modification.

Another object of the present invention is to provide a clean-in-place system which will clean, using different programmable cycles, a multitude of materials.

A still further object of the present invention is to provide a clean-in-place system which will clean the complete filling path using standard elements without modification.

These and other objects of the present invention are achieved in a clean-in-place filling machine which includes a supply tank connected to a filling nozzle by a filling unit and additionally a flush tank connected to a pump or drain outlet by a valve. A programmable controller operates the machine to fill a container with product from the supply tank via the filling unit and the nozzle. The controller also performs a clean-in-place with a pre-rinse, a wash and a final rinse. The initial rinse is performed by rinsing with a rinsing fluid introduced into the supply tank and exiting the drain outlet via the filling unit, the nozzle, the flush tank and the valve. This is followed by washing with cleaning fluid from the flush tank via the valve, the pump, the supply tank, the filling unit and the nozzle back to the flush tank. This is a closed loop wherein the pressure is provided by the pump and the filling unit is operated to drain the supply tank. The final rinse, rinses with rinsing fluid introduced into the supply tank and exiting the drain outlet via the filling unit, the nozzle, the flush tank and the valve. The pump is disconnected from the supply tank during the final rinse and the valve may be operated to alternately connect the rinsing fluid from the flush tank to the pump to also clean the pump separately.

A sprayer is connected to the inlet of the supply tank during the washing and rinsing to provide a spray pattern of high velocity to clean all the exposed surfaces of the supply tank. The filling unit is operated to drain the supply tank and maximizes the exposed surfaces during washing and rinsing. The rinsing fluid supply provided to the supply tank and the pump provide sufficient velocity to operate the sprayer.

Since the flush tank is part of the initial rinse cycle, the controller provides the cleaning chemicals and water to the flush tank after the initial rinse cycle. The chemicals are received from one or more tanks through appropriate controls and a separate mixing water inlet. Thus the cleaning fluids are introduced and mixed in the flush tank. The water inlet of the flush tank may also be used in addition to the water introduced in the supply tank during the final rinse.

The filling unit includes a piston pump, a driver and a ball valve all operated by the controller. The controller operates the driver and the ball valve differently during the fill cycle than during the cleaning cycles. During a different portion of the cleaning cycle, the controller operates the driver such that the piston pump has a different intake and discharge stroke. The difference in the velocity of strokes create different turbulence at the inlet verses the outlet for different diameter inlets and outlets. Similarly, the ball valve may be operated for a given number of cycles during the cleaning process so as to maintain the inlet to the piston pump open and the outlet closed for one or more complete cycles to create turbulence at the inlet. The controller can also operate the driver to withdraw the piston from the piston pump to drain the piston pump at the end of the cleaning process. This preferably is accomplished using a ball screw drive.

A method of operating a clean-in-place filling machine which includes a tank connected to a filling nozzle by a filling unit and a flush tank connected to a pump by a valve which also has a drain outlet, includes an initial rinsing, followed by a washing, then by a final rinsing step. The initial rinsing step, rinses with rinsing fluid introduced into the supply tank and exiting the outlet drain via the filling unit, the nozzle, the flush tank and the valve. The washing step includes washing with cleaning fluid from the flush tank via the valve, the pump connected to the supply tank, the supply tank, the filling unit and the nozzle back into the flush tank. The final rinsing cycle rinses with rinsing fluid introduced into the supply tank and exiting the drain outlet via the filling unit, the nozzle, the flush tank and the valve. The process begins by disconnecting the product supply from the supply tank and connecting a source of rinsing fluid under pressure to the supply tank including a sprayer. The nozzle is moved from the filling position to the flush tank. After the initial rinsing cycle, the flush tank is filled with cleaning fluid and the source of rinsing fluid is disconnected from the supply tank and the outlet of the pump is connected to the supply tank via the sprayer. After the washing cycle, the pump is disconnected from the inlet of the supply tank and a source of rinsing fluid is connected to the supply tank via the sprayer. In the final rinse step, additional water may be provided directly to the flush tank. Also the valve may be operated to alternately connect the fluid from the flush tank to the pump as well as the drain to clean the pump during the final rinse.

Other objects, advantages and novel features of the present invention will become apparent from the following detailed description of the invention when considered in conjunction with the accompanying drawings.

BEST MODES FOR CARRYING OUT THE INVENTION

Figure 1:
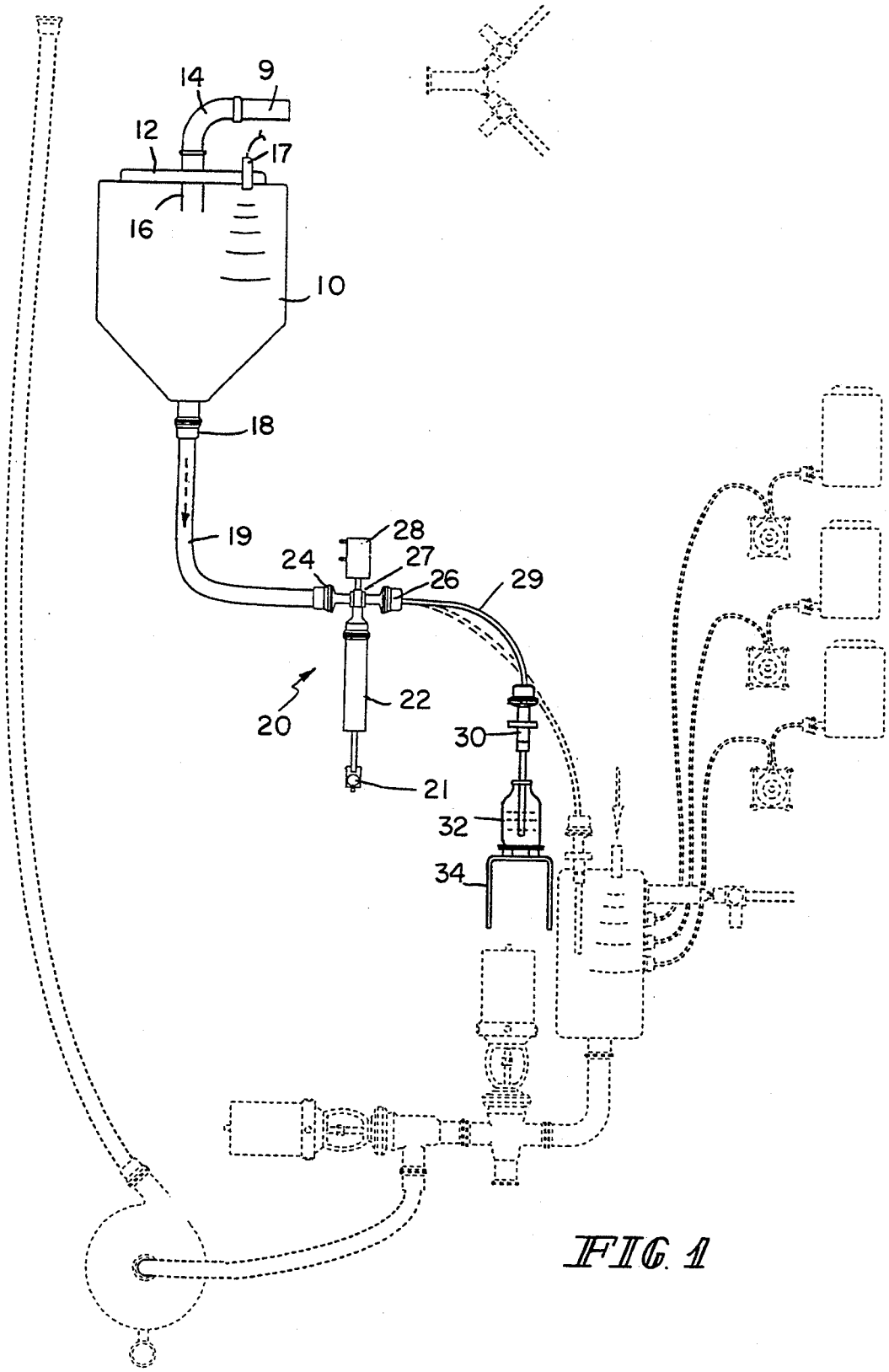
FIG. 1 is a schematic representation of a clean-in-place system according to the present invention for a filling mode.

The filling machine as illustrated in FIG. 1, includes a supply tank 10 having a top 12 including an inlet 14 connected to a product supply manifold 9 and terminating inside the supply tank 10 with a tube 16. A fluid level sensor 17 is provided to determine the liquid level in the supply tank 10. It may be a conductive or sonar sensor. The outlet of the supply tank 18 is connected by tubing 19 to a filling unit 20. Filling unit 20 includes a piston pump 22 connected to a driver 21. The driver is not shown in FIGS. 1–5 and will be discussed in more detail with respect to FIG. 6. The filling unit 20 includes an inlet 24 and an outlet 26. A rotary actuator 28 controls a rotary or ball valve 27 to interconnect the inlet 24 and the outlet 26 in combination with the stroke of the piston pump 22 to define the intake and discharge cycles. A tubing 29 connected to the outlet 26 of the filling unit is connected to the filling nozzle 30 at the filling station 34 to fill a container 32. Although FIG. 1 illustrates a single filling unit 20 and a single nozzle 30, the supply tank 10 may be a manifold having a plurality of parallel filling units with a corresponding plurality of nozzles 30 operated simultaneously to fill a plurality of correspondence containers 32.

A controller not shown in FIGS. 1–5 maintains a given level of supply in the supply tank, operates rotary actuator 28 and the piston pump 22 to dispense metered amounts or doses of material into a container 32. It also operates the transport to raise and lower the nozzle 30 as well as to move empty containers under the nozzle 30 and remove filled containers 32. The operation of the filling portion is well known and is not described herein in detail. The only importance is that the filling cycle includes rotating the ball valve 27 to open the inlet 24 and close the outlet 26 during an intake stroke and close the inlet 24 and open the outlet 26 during the discharge stroke. The discharge and intake stroke of the piston are generally the same, although they may vary in velocity over the length of travel of the piston. It should be noted that the portions shown in phantom FIG. 1 are part of the clean-in-place system and are not described in FIG. 1 since they are not part of the filling mode.

Figure 2:
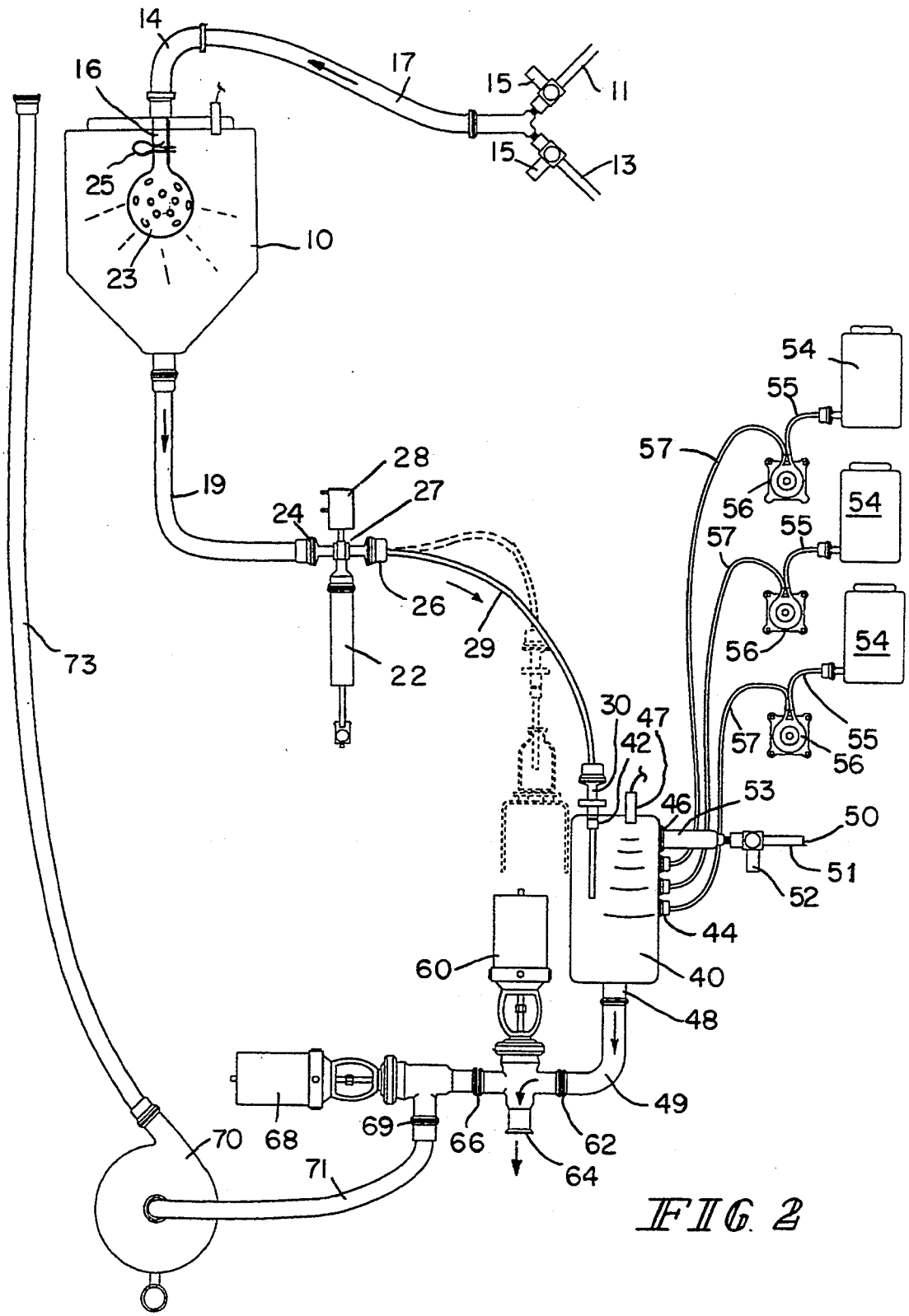
FIG. 2 is a schematic representation of a clean-in-place system according to the present invention in a first rinse mode.

The cleaning process begins by operating the filling unit 22 to empty any remaining material in the supply tank through the flush tank 40 and the drain outlet 64. A first, burst rinse is performed as illustrated in FIG. 2. The product supply line 9 is disconnected from inlet tube 14 and lid 12 is removed from the supply tank 10. A spray ball 23 is applied to the end of the internal tube 16 by a snap ring 25. A manifold, including sources of hot water 11 and cold water 13, are provided through control valves 15 to the inlet 14 via tubing 17. The nozzle 30 is removed from the fill station and inserted into an inlet 42 of a flush tank 40. The flush tank 40 also includes a plurality of inlets 44 for receiving cleaning solutions and inlet 46 for receiving mixing water. The flush tank 40 includes an outlet 48 and a fluid level sensor 47. The cleaning fluids are received from a plurality of cleaning fluid storage tanks 54 via tubing 55, individual pumps 56 and tubing 57 connected to the cleaning fluid inlets 44 of the flush tank 40. Mixing water at port 50 is connected to the inlet 46 of the flush tank via tubing 51, control valve 52 and tubing 53. The outlet of the flush tank 48 is connected by tubing 49 to a inlet 62 of valve 60. Valve 60 has a first outlet 64 acting as a drain and an outlet 66. The outlet 66 is connected as an inlet of a second valve 68 which has an outlet 69 connected to centrifugal pump 70 by tubing 71. The output of pump 70 is connected to a tube 73.

In the initial burst rinse, the controller provides the appropriate temperature water through the control valves 15 to the supply tank 10. The pressure of the water is sufficiently high and in combination with the spray ball 23 to project the pattern of high pressure fluid to burst rinse the supply tank 10. The rinse fluid in supply tank 10 is continuously drained by operation of the piston pump 22 to the flush tank 40 via the nozzle 30. The piston pump 22 is operated to keep the supply tank drained and maximize the exposed surface of the supply tank. If rinsing or washing fluids were allowed to accumulate in the supply tank, the covered surfaces would not be rinsed or washed. The speed of operation and stroke length is substantially greater than that of the fill cycle since the capacity of flush tank 40 is greater than any of the containers 32. The valve 60 connects the output of the flush tank 40 to the drain outlet 64. The controller operates the filling unit 20 for a predetermined number of cycles required for the specific product to remove the bulk salvage left in the tank and the filling unit. Depending upon environmental requirements, the drain outlet 64 may go to an open sewer or may be provided into a container for further removal. The source of rinsing fluid is from the inlet 14 of the supply tank and the flush tank 40 does not provide any additional supply of fluid. The centrifugal pump 70 is not part of the first rinsing cycle and the flushing fluid is provided to the drain outlet 64 through the flush tank 40. There are no cleaning chemicals provided in the flush tank 40 at this portion of the cycle. A single inlet 14 to the supply tank for product, rinsing fluid and cleaning fluids from the pump is used. This assures cleaning of all the product connections and minimizes the sources of contamination if multiple inlets to the supply tank 10 were provided.

If a system is used where in the inlet 24 and the outlet 26 of the piston pump 22 are the same diameter, the intake and discharge stroke of the piston pump 22 may be the same. In the illustrated embodiment, the inlet 24 is substantially greater than the outlet 26. Thus, by having the same intake cycle to discharge cycle, the same velocity of fluid at the intake 24 and outlet 26 cannot be maintained with the rinsing and washing fluids. This reduces the turbulence and the ability to clean the inlet 24. The controller, to address this issue, operates the intake stroke substantially faster than the discharge stroke to create greater turbulence at the inlet 24. Similarly, the ball valve 27 may be controlled such as to leave the inlet 24 open, a small portion, during the discharge stroke to create a back pressure at the inlet 24. More preferably, the ball valve 27 is operated so as to keep the inlet 24 open and the outlet 26 closed during a plurality of cycles of intake and discharge strokes of the piston pump 22. This provides high turbulent two-way flow through the inlet 24. This turbulence should remove a substantial amount of material at the inlet 24.

Figure 3:
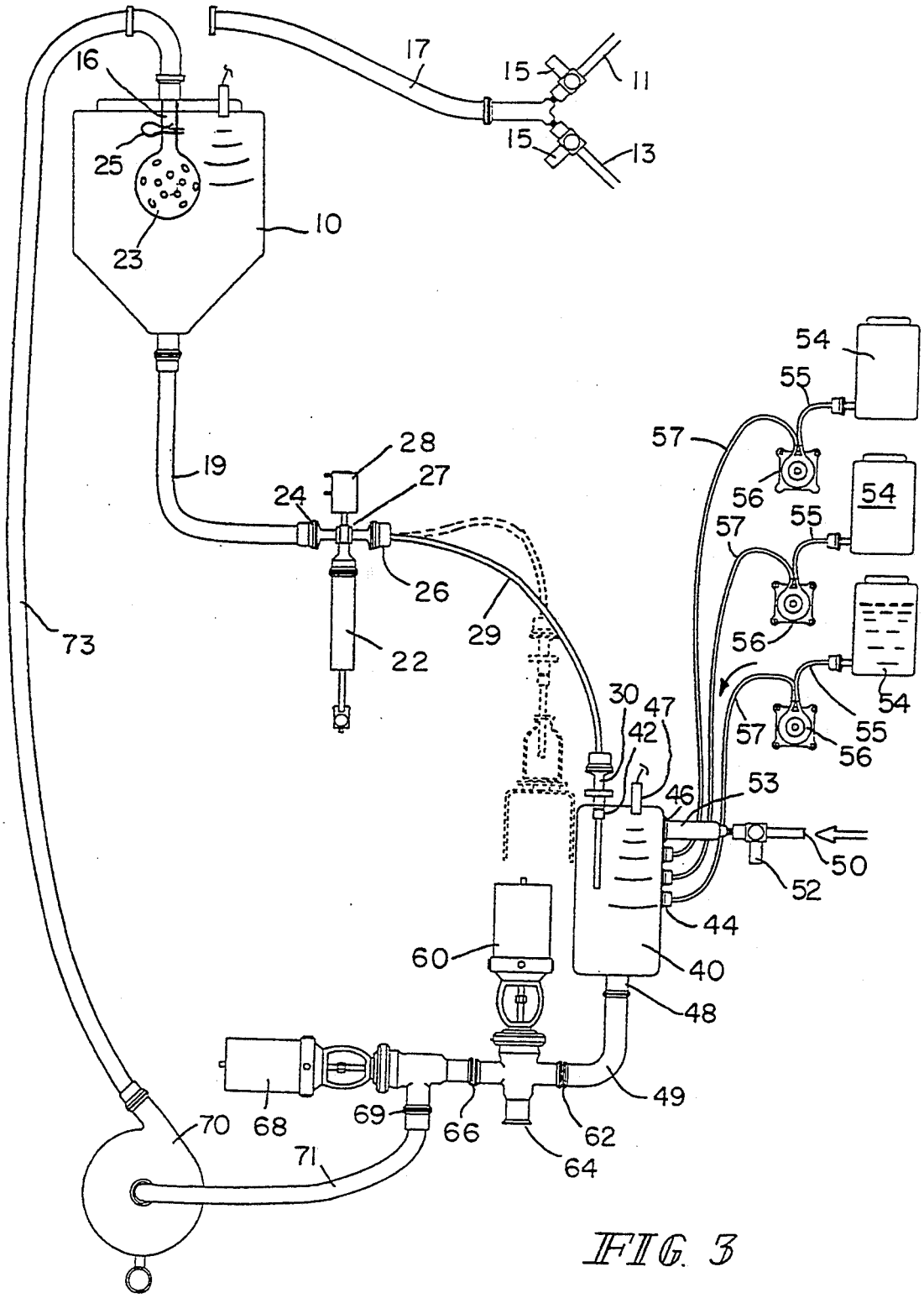
FIG. 3 is a schematic representation of a clean-in-place system according to the present invention showing the chemical mix mode.
Figure 4:
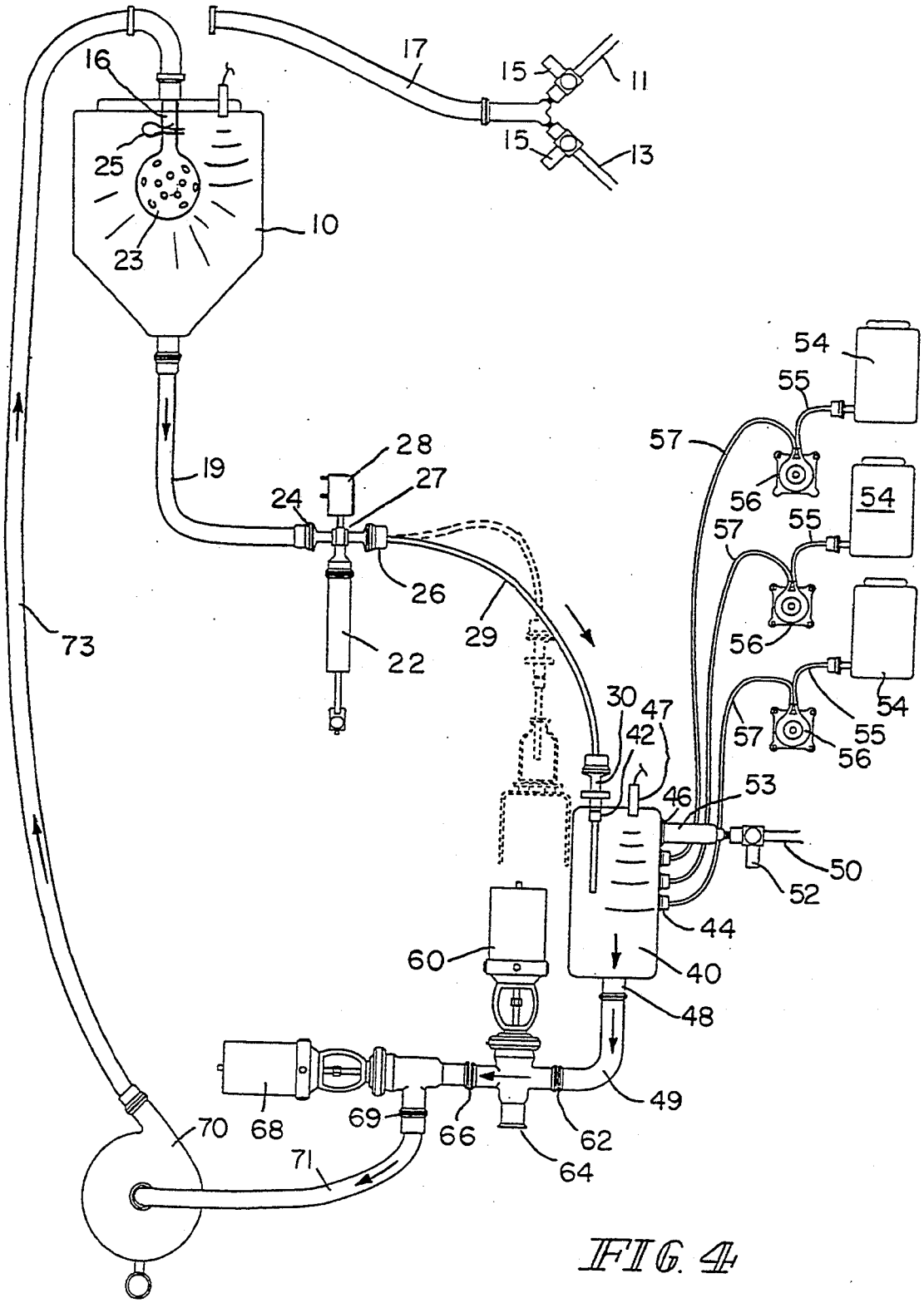
FIG. 4 is a schematic representation of a clean-in-place system according to the principles of the present invention in a wash mode.

Once the initial burst rinse has been completed, the washing cycle is initiated. As illustrated in FIG. 3, valve 52 is operated to provide an appropriate amount of mixing water into the tank 40 until an appropriate level is sensed by level sensor 47. Next, one or more of the metering pumps 66 is operated to dispense a predetermined amount of cleaning fluid from cleaning fluid tanks 54 into the flush tank 40. The specific kind of cleaning material used as well as its concentration is determined by the product being used during the fill cycles. The valve 60 closes the drain outlet 64 and connect the inlet 62 to its outlet 66. A second valve 68 is closed to prevent the fluid in inlet 66 from reaching outlet 69 and pump 70. During the chemical mixing step of FIG. 3, the cleaning water supply manifold of tube 17 is disconnected from the inlet 14 of the supply tank 10. At the same time, the tube 73 at the outlet of pump 70 is connected to the inlet 14 of the supply tank through the spray ball 23. Although the valves 15 are turned off after the initial rinse, the disconnection of the cleaning fluid pipe 17 and connection of the pump tube 73 can take place before, during or after the chemical mix mode of FIG. 3.

After the chemicals from supply tanks 54 are appropriately mixed with the mixing water from port 50 in the flushed tank 40, valve 68 connects its inlet 66 to its outlet 69 to provide communication to the pump 70. The centrifugal pump 70 and the piston pump 22 and rotary valve actuator 28 are operated to wash the system through a closed loop. The washing fluid in flush tank 40 is connected through the valves 60 and 68 to the pump 70, through the supply tank 10 via the sprayer 23, via piston pump 22 and nozzle back to the flush tank 40. The pump 70 is activated approximately 10 seconds, for example, after valve 68 is opened. The filling units 20 are activated approximately 15 seconds, for example, after valve 68 is opened. These delays allow the cleaning fluid to be available at the inlets of the pump and filling units. The pump 70 provides a high pressure stream through the ball 23 to impact and wash all the exposed surfaces of the supply tank 10. As discussed before, the piston pump 22 is operated in such a manner to maintain the supply tank substantially empty, thereby maximizing the amount of exposed surface. As in the rinse cycle of FIG. 2, the controller operates the piston pump 22 and the three-way valve 27 so as to produced increased turbulence at the inlet 24.

Mixing and supplying the washing chemicals and fluids in the flush tank 40, allows the exposure of substantially all the interior surface of supply tank 10. It should also be noted that the volume of flush tank 40 is substantially smaller than that of supply tank 10. Flush tank 40 is generally between one-half to one-third the volume of supply tank 10. This provides better control over the mixing process of the water and washing materials. By providing a plurality of sources 54 of chemicals, the flush tank 40 in combination with valves 60 and 68 may drain the system to provide a second chemical wash all automatically through the controls of the pumps 56 and valves 60 and 68. The washing fluid is circulated for a predetermined number of cycles necessary to dissolve all remaining product from any internal surfaces.

Figure 5:
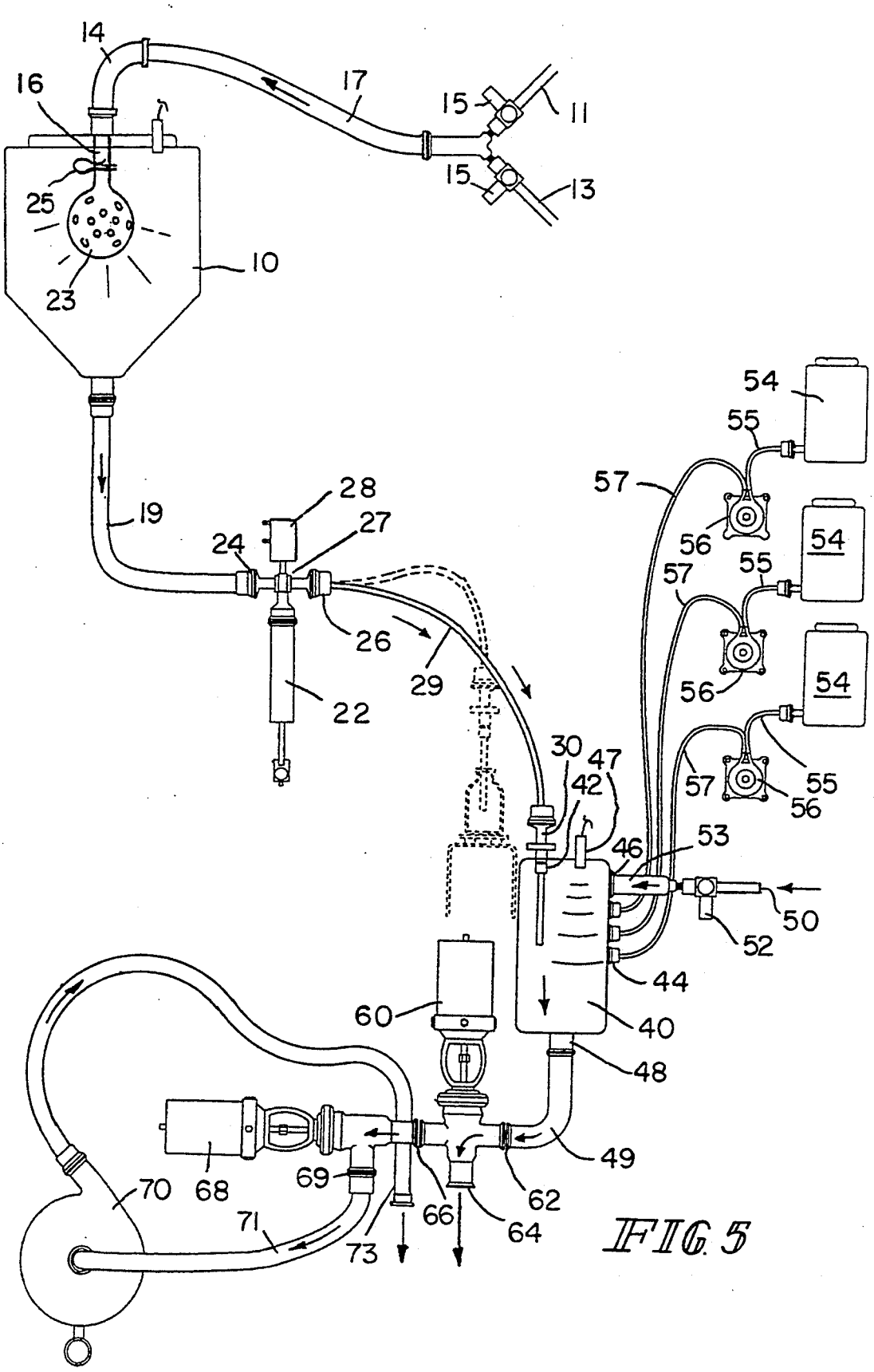
FIG. 5 is a schematic representation of a clean-in-place system according to the principles of the present invention in a final rinse mode.

At the end of the wash mode, a final rinse mode is conducted as illustrated in FIG. 5. The pump outlet tube 73 is disconnected from the inlet 14 of the supply tank 10 and the tube 17 of the cleaning water manifold is connected to inlet 14 and the spray ball 32. The piston pump 22 and the ball valve 27 are operated in such a manner as to maintain the fluid level in the supply tank 10 such that all exposed surfaces can be cleaned by the high pressure force from the cleaning manifold in pipe 17. In addition to the rinsing water coming from the supply tank 10 and the piston pump 22, valve 52 is open to bring in additional rinsing fluid from the mixing water 50 into the flush tank 40. Valve 60 connects its inlet 62 to the drain outlet 64. This allows the cleaning fluid to go directly to the drain as in the initial flush of FIG. 2. In order to clean the pump 70, the valve 60 may alternately connect the rinsing fluid from flush tank 40 to the pump 70 by connecting inlet 62 to the outlet 66 and valve 68 connecting its inlet 66 to outlet 69. The output 73 of the pump is also connected to a drain. A comparison between FIGS. 4 and 5 would indicate that the pump 70 does not take part of the rinsing process with respect to the supply tank 10. Pump 70 is independently rinsed. This reduces the contamination of the filler portion beginning with supply tank 10, ball valve 27, piston pump 22 and nozzle 30.

At the end of the final rinse, the hot water at manifold 17 is cut off and cold water from manifold 17 is provided to supply tank 10 and cold water from port 50 is provided to the flush tank 40. The cold water is circulated to cool the system down to an ambient temperature. When the final rinse mode of FIG. 5 is completed the drive for the piston pump 22 is operated to fully extract the piston from the cylinder. This allows examination of the seals and draining of any residual rinsing fluids. This is done automatically through the drive and requires no manual intervention. The flushing manifold 17 is disconnected from the fill tank 10 and the spray ball 23 is removed. Then, the nozzle 30 is then moved back to the filling station and a product supply is connected to the inlet 14 of the supply tank 10. The system then is in the position as illustrated in FIG. 1.

Figure 6:
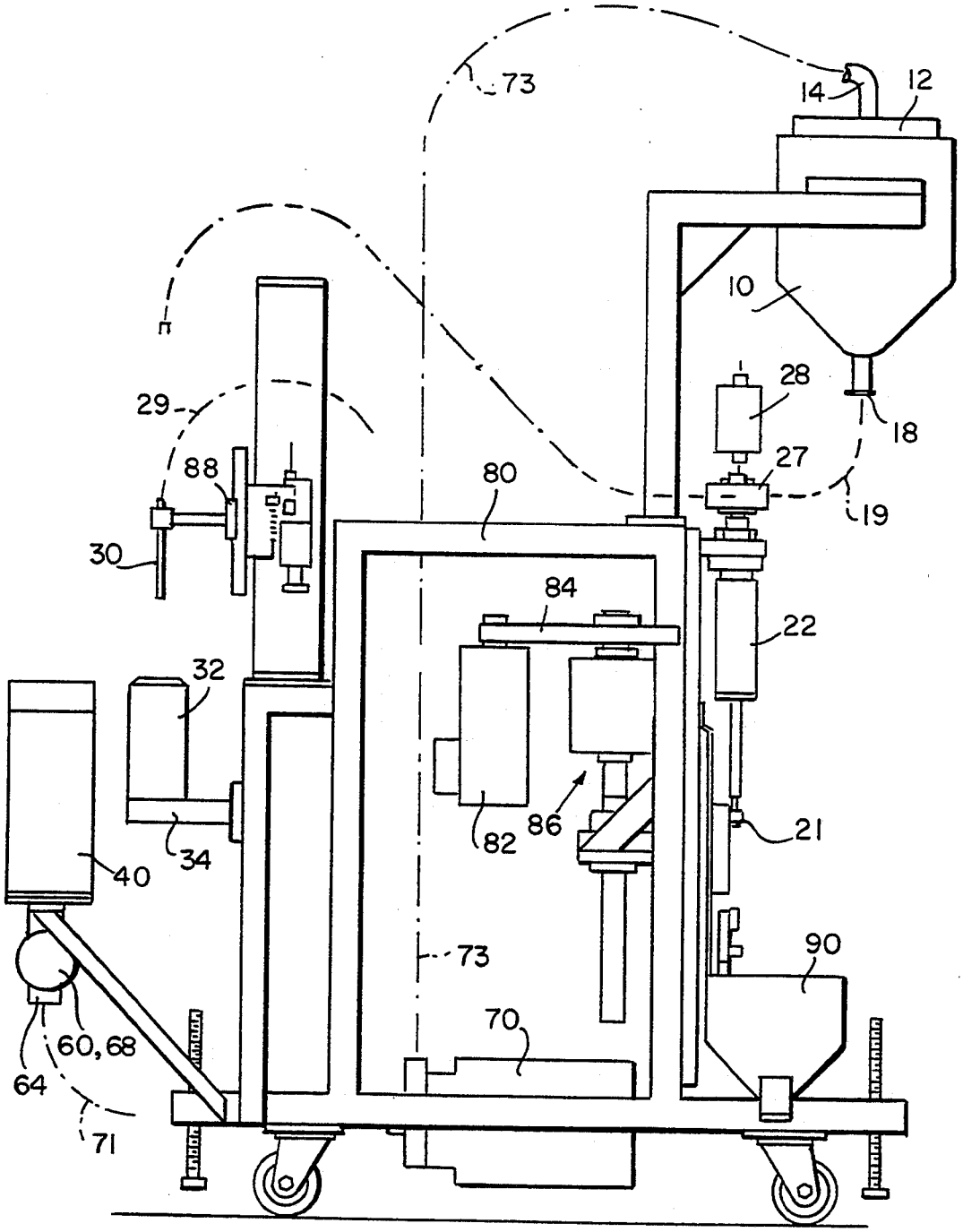
FIG. 6 is a side elevation of a clean-in-place system incorporating the principles of the present invention.

The general location of the elements on a clean-in-place filling machine is illustrated in FIG. 6. The tubings shown are removed and generally shown in dotted lines. The general frame of the filling machine is illustrated as 80. Mounted to the rear of the frame is the supply tank 10. Adjacent thereto and connected by tube 19 are mounted the rotary valve actuators 28, ball valves 27 and piston pumps 22. The drive mechanism connected at 21 to the piston of the piston pump 22 includes a motor 82 connected by a belt 84 to a ball screw drive 86. The controller controls motor 82 to determine the direction, the speed and the distance of travel of the ball screw and thereby controls the operation of the piston pump 22. A single ball screw drive is used to control a plurality of ganged piston pumps 22.

Mounted on the front of the machine is a nozzle carriage 88. Operated by the controller, this raises and lowers the plurality of nozzles 30 into and out of container 32 at the filling station. Although not shown, the carriage 88 can also be designed to move the nozzle 30 from the filling station to the flush tank 40 mounted adjacent to the filling station or conveyor 34. In a simpler model, the nozzles are moved manually from the carriage 88 into inlets 42 of the flush tank 40. The flush tank 40 has a plurality of inlets, one for each of the nozzles. The flush tank 40 includes a drain outlet 64 and is connected by tubing 71 to the pump 70, mounted to the bottom of the frame 80. Tubing 73 connects the outlet of the pump to the input 14 of the supply tank 12. A trough 90 is provided on the back of the frame, below the piston pumps 22, such that when the drive 86 fully extracts the piston from the piston pump, it will catch any fluid coming from the piston pump cylinder. The ball screw drive 86 not only provides the ability to control the direction, speed and throw of the piston, it also allows the ability to fully extract the piston from the piston pump cylinder.

Figure 7:
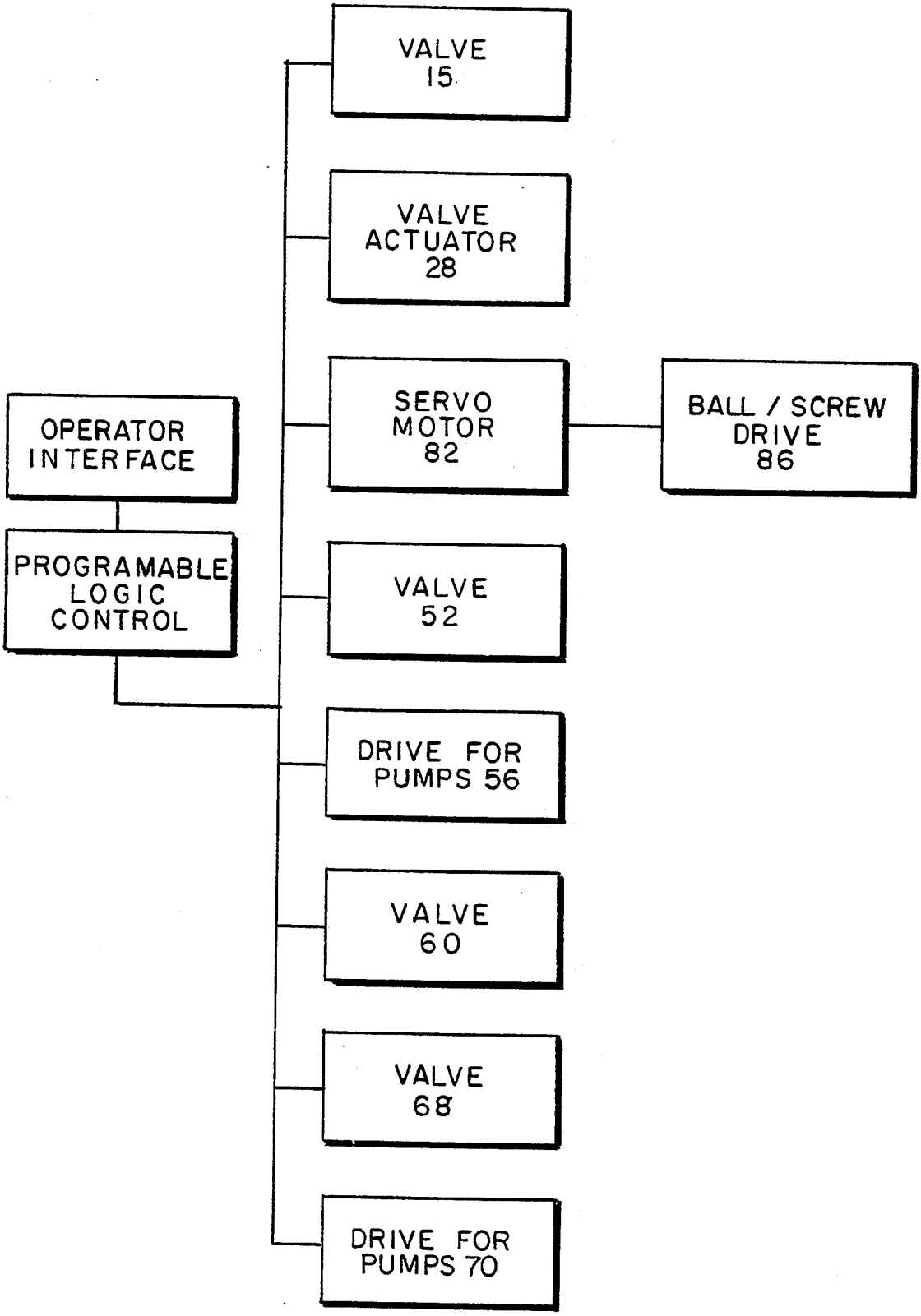
FIG. 7 is a block diagram of the control system incorporating the principles of the present invention.

What is not shown for sake of clarity, are the chemical supply tanks 54 and their pumps 56 which are mounted also on the frame 80. This is a complete integral system to allow filling as well as clean-in-place. The controller is shown in Detail in FIG. 7. A controller is a programmable logic controller, normally used for the control of the filling machine. It is additionally programmed to provide the various cycles for the clean-in-place. The use of programmable logic instead of relays and digital logic allows modification of the cleaning cycle depending upon the material being dispensed. This includes selection of not only the kind and the number of piston strokes, but also the kind of chemicals to be introduced into the flush tank 40. The particular number and kind of cycles required to clean the system will be produced empirically after running various experiments. The ability to continuously change the cleaning cycle is an important feature.

A typical clean-in-place cycle has a pre-wash or burst rinse, with water in the range of 160° to 180° F. for approximately 15 minutes. This is followed by a chemical wash using water as a mixture, again using water in the temperature range of 160° to 180° F. for approximately 30 minutes. The final rinse begins at 160° F. and is reduced to ambient. This final rinse is for approximately 15 minutes. The sanitized cycle either by introducing a gas or air drying would last for approximately five minutes. If the filling machine is used to fill a chemical like Digel available from Scherring-Plough, the typical cleaning chemical would be AC30. The same machine may also be used to fill Suncare lotions also for Scherring-Plough. In that case the cleaning chemical would be Cosmetic L. Since there are manual operations between modes or phases of the clean-in-place operation, the controller will stop at each mode and require operator intervention to initiate the next step. If automatic connection and disconnection is provided, the system would be completely automatic with no operator intervention.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A method of cleaning-in-place a filling machine including a supply tank connected to a filling nozzle by a filling unit and a flush tank connected to a pump by a valve which also has a drain outlet comprising the steps of:

a) initially rinsing said supply tank, said filling unit and said nozzle with rinsing fluid exiting said drain outlet via said flush tank and said valve;

b) filling said flush tank with water and mixing with cleaning fluid from a cleaning fluid source subsequently introduced into said flush tank;

c) washing with mixed cleaning fluid from said flush tank via said valve, said pump, said supply tank, said filling unit and said nozzle back to said flush tank; and c) finally rinsing said supply tank, said filling unit and said nozzle with rinsing fluid exiting said drain outlet via said flush tank and said valve.

2. A clean-in-place filling machine including a filling unit, a filling nozzle and a supply tank connected to said filling nozzle by said filling unit and comprising:

said filling unit includes a piston pump having a piston, a driver and a valve means; and control means for operating said driver and said valve means according to a first cycle for filling a container and according to a second cycle different from said first cycle during cleaning and for operating said driver to withdraw said piston from said piston pump to drain the piston pump as a third cycle.

3. A clean-in-place filling machine including a filling unit, a filling nozzle and a supply tank connected to said filling nozzle by said filling unit and comprising:

said filling unit includes a piston pump having a piston, a driver and a valve means;

control means for operating said driver and said valve means according to a first cycle for filling a container and according to a second cycle different from said first cycle during cleaning; and said control means operating said valve means to maintain an inlet to the piston pump open and an outlet of the piston pump closed for one or more complete cycles of the piston pump to create turbulence at the inlet in said second cycle.

4. A clean-in-place filling machine including a filling unit, a filling nozzle and a supply tank connected to said filling nozzle by said filling unit and comprising:

a flush tank having a nozzle inlet, cleaning fluid inlet and an outlet;

valve means having an inlet, a pump outlet and drain outlet for selectively connecting said inlet to said pump and drain outlets;

pump means having an inlet connected to said pump outlet of said valve means and having an outlet selectively connected to an inlet of said supply tank; and control means for operating said machine to a) fill a container with product from said supply tank via said filling unit and said nozzle, b) initially rinse with rinsing fluid introduced into said supply tank and exiting said drain outlet via said filling unit, said nozzle, said flush tank and said valve means, c) wash with cleaning fluid from said flush tank via said valve means, said pump means, said supply tank, said filling unit and said nozzle back to said flush tank, and d) finally rinse with rinsing fluid introduced into said supply tank and exiting said drain outlet via said filling unit, said nozzle, said flush tank and said valve means.

5. A machine according to claim 4 wherein said supply tank includes an inlet and a sprayer connected to said inlet during washing and rinsing.

6. A machine according to claim 5 wherein said control means operates said filling unit during washing and rinsing to drain said supply tank and maximize exposure of an interior surface of said supply tank.

7. A machine according to claim 1 wherein said control means fills said flush tank with cleaning fluid via said cleaning fluid inlet after said initial rinse and before said wash.

8. A machine according to claim 7 wherein said flush tank includes a plurality of cleaning fluid inlets and said control means selects one or more of said cleaning fluids to be introduced.

9. A machine according to claim 8 wherein one of said plurality of cleaning fluid inlets is connected to a source of water and said control means introduces water into said flush tank with said cleaning fluids and during said final rinse.

10. A machine according to claim 4 wherein said control means, in said final rinse, alternates the connection of the valve means inlet to said drain outlet and said pump inlet to also provide rinsing fluid from said valve means to said pump means to rinse said pump.

11. A machine according to claim 4 wherein said filling unit includes a piston pump, a driver and a ball valve; and said control means operates said driver and said ball valve.

12. A machine according to claim 11 wherein said control means operates said driver to have different intake and discharge strokes during one or more of the rinsing or washing.

13. A machine according to claim 11 wherein said control means operates said ball valve to maintain an inlet to the piston pump open and an outlet of the piston pump closed for one or more complete cycles of the piston pump to create turbulence at the inlet during one or more of the rinsing or washing.

14. A clean-in-place filling machine including a filling unit, a filling nozzle and a supply tank connected to said filling nozzle by said filling unit and comprising:

said filling unit includes a piston pump having a piston, a driver and a valve means; and control means for operating said driver and said valve means according to a first cycle having at least the same length of travel for intake and discharge strokes of said pump for filling a container and according to a second cycle different from said first cycle and having at least different speed of travel for intake and discharge strokes of said pump during cleaning.

15. A method of cleaning-in-place a filling machine including a supply tank connected to a filling nozzle by a filling unit and a flush tank connected to a pump by a valve which also has a drain outlet comprising the steps of:

a) initially rinsing said supply tank, said filling unit and said nozzle with rinsing fluid introduced into said supply tank and exiting said drain outlet via said filling unit, said nozzle, said flush tank and said valve;

b) washing with cleaning fluid from said flush tank via said valve, said pump, said supply tank, said filling unit and said nozzle back to said flush tank; and c) finally rinsing with rinsing fluid introduced into said supply tank and exiting said drain outlet via said filling unit, said nozzle, said flush tank and said valve.

16. A method according to claim 15 including, prior to step a),:

d) disconnecting a product supply source from an inlet of said supply tank and connecting a source of rinsing fluid under pressure to said supply tank inlet via a sprayer; and e) moving said nozzle from a filling position to said flush tank.

17. A method according to claim 15 including, after step a) and before step b),:

f) filling said flush tank with said cleaning fluid; and g) disconnecting a source of rinsing fluid from and connecting an outlet of said pump to the inlet of said supply tank via a sprayer.

18. A method according to claim 15 including, after step a) and before step b), filling said flush tank with water and mixing with said cleaning fluid from one of a plurality of cleaning fluid sources subsequently introduced into said flush tank.

19. A method according to claim 15 including, after step b) and before step c), disconnecting said pump from said supply tank and connecting a source of rinsing fluid via a sprayer.

20. A method according to claim 19 including, during step c), operating said valve to alternate the connection of said flush tank to said discharge outlet and said pump to rinse said pump.

21. A method according to claim 15 wherein said filling unit includes a piston pump; and including operating said piston pump to have different intake and discharge strokes.

22. A method according to claim 15 wherein said filling unit includes a piston pump and a ball valve; and including controlling said ball valve to maintain an inlet to the piston pump open and an outlet of the piston pump closed for one or more complete cycles of the piston pump to create turbulence at the inlet.

23. A method according to claim 15 including attaching a sprayer to the inlet to said supply tank before step a) and operating said filling unit during washing and rinsing to drain said supply tank and maximize the exposed surface of said supply tank.

* * * * *